US010737922B2

(12) United States Patent
Werner et al.

(10) Patent No.: US 10,737,922 B2
(45) Date of Patent: Aug. 11, 2020

(54) MECHANICALLY ACTUATED LOAD STABILIZER FOR PALLET JACKS

(71) Applicant: INTERNATIONAL BUSINESS MACHINES CORPORATION, Armonk, NY (US)

(72) Inventors: John S. Werner, Fishkill, NY (US); Noah Singer, New City, NY (US); Budy Notohardjono, Poughkeepsie, NY (US); Arkadiy O. Tsfasman, Wappingers Falls, NY (US)

(73) Assignee: International Business Machines Corporation, Armonk, NY (US)

( * ) Notice: Subject to any disclaimer, the term of this patent is extended or adjusted under 35 U.S.C. 154(b) by 182 days.

(21) Appl. No.: 16/058,347

(22) Filed: Aug. 8, 2018

(65) Prior Publication Data

US 2020/0048059 A1 Feb. 13, 2020

(51) Int. Cl.

| | |
|---|---|
| ***B66F 9/075*** | (2006.01) |
| ***B66F 17/00*** | (2006.01) |
| ***B66F 9/065*** | (2006.01) |

(52) U.S. Cl.

CPC ..... *B66F 9/07559* (2013.01); *B66F 9/065* (2013.01); *B66F 17/003* (2013.01)

(58) Field of Classification Search

None

See application file for complete search history.

(56) References Cited

U.S. PATENT DOCUMENTS

| | | | | |
|---|---|---|---|---|
| 3,039,638 | A * | 6/1962 | Shaffer | B66F 9/07559 414/635 |
| 5,147,170 | A | 9/1992 | Detrick | |
| 5,312,219 | A * | 5/1994 | Brown | B66F 9/105 180/6.48 |
| 5,628,377 | A | 5/1997 | Le Gloan | |
| 5,931,499 | A * | 8/1999 | Sutherland | B60R 21/00 180/282 |
| 6,343,674 | B1 * | 2/2002 | Sexsmith | B66F 9/07522 180/19.2 |
| 6,551,050 | B1 * | 4/2003 | Kallevig | B60G 21/005 180/209 |
| 7,641,011 | B2 | 1/2010 | Fridlington, Jr. et al. | |
| 7,798,508 | B2 | 9/2010 | Wettlaufer, Jr. | |
| 8,763,990 | B2 | 7/2014 | Day | |
| 9,714,047 | B1 | 7/2017 | Shunli et al. | |

(Continued)

*Primary Examiner* — Jonathan M Dager
*Assistant Examiner* — Garrett F Evans
(74) *Attorney, Agent, or Firm* — Tihon Poltavets

(57) ABSTRACT

An apparatus for load stabilization on a pallet jack includes one or more steerable wheels, a stabilizer member, and an A-Frame, where the A-Frame encloses a plurality of components for mechanically coupling the one or more steerable wheels to the stabilizer member. The stabilizer member is extendable out of at least one side of the pallet jack based at least on an angle of rotation of the one or more steerable wheels. A method for load stabilization on a pallet jack includes receiving a steering angle for one or more steerable wheels of a pallet jack from an angular position sensor. The method includes activating an electric motor for extending a stabilizer member of the pallet jack, where a distance of extension of the stabilizer member is based on the steering angle for one or more steerable wheels of the pallet jack.

20 Claims, 8 Drawing Sheets

(56) References Cited

U.S. PATENT DOCUMENTS

| | | | | |
|---|---|---|---|---|
| 9,963,331 | B1 * | 5/2018 | Holmberg | G05D 1/0272 |
| 2008/0164101 | A1 * | 7/2008 | Stone | B66F 9/06 187/231 |

* cited by examiner

MECHANICALLY ACTUATED LOAD STABILIZER FOR PALLET JACKS

FIELD OF THE INVENTION

This disclosure relates generally to pallet jacks, and in particular, to a structure for providing pallet load and pallet jack stabilization.

BACKGROUND OF THE INVENTION

A pallet jack is a basic form of a forklift utilized to lift and maneuver pallets of heavy components and products typically used in a manufacturing setting. A typical pallet jack includes two forks protruding out of an A-Frame onto which a pallet rests, where a movement of the pallet jack is dictated by one or more steerable wheels mechanically coupled to the A-Frame and a steering mechanism. Pallets being maneuvered by the pallet jack are prone to tipping due to a high center of gravity and load imbalance. For example, if an operator turns the pallet jack quickly, the momentum of the heavy components and products on the pallet can cause both the pallet and pallet jack to tip over.

SUMMARY

One aspect of an embodiment of the present invention discloses an apparatus for load stabilization on a pallet jack, the apparatus comprising the pallet jack includes one or more steerable wheels, a stabilizer member, and an A-Frame, wherein the A-Frame encloses a plurality of components for mechanically coupling the one or more steerable wheels to the stabilizer member. The apparatus further includes the stabilizer member being extendable out of at least one side of the pallet jack based at least on an angle of rotation of the one or more steerable wheels.

A second aspect of an embodiment of the present invention discloses a method comprising receiving, by one or more processors, a steering angle for one or more steerable wheels of a pallet jack from an angular position sensor and activating, by one or more processors, an electric motor for extending a stabilizer member of the pallet jack, wherein a distance of extension of the stabilizer member is based on the steering angle for one or more steerable wheels of the pallet jack.

BRIEF DESCRIPTION OF THE SEVERAL VIEWS OF THE DRAWINGS

The following detailed description, given by way of example and not intended to limit the disclosure solely thereto, will best be appreciated in conjunction with the accompanying drawings, in which.

DETAILED DESCRIPTION

Figure 1:
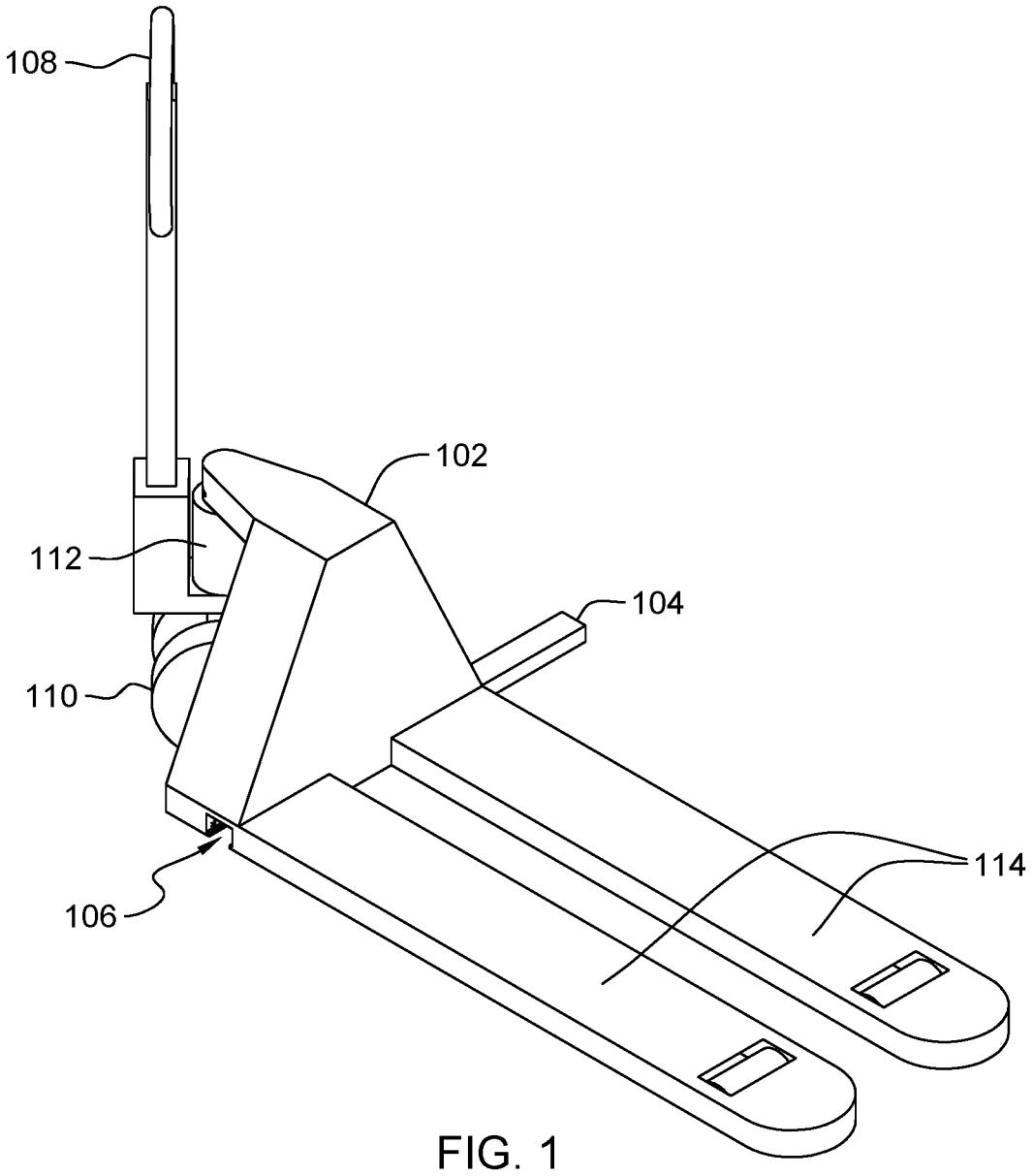
FIG. 1 depicts a pallet jack with a load stabilizer member, in accordance with an embodiment of the present invention.

Embodiments of the present invention provide a pallet jack with an extendable and retractable stabilizer member and integrated casters within an A-Frame of the pallet jack. The stabilizer member is mechanically coupled to a steering handle (i.e., tow bar), where the stabilizer member extends out of the A-Frame of the pallet jack to provide additional stabilization when a user turns the pallet jack with the steering handle. The mechanical components for coupling the steering handle to the stabilizer member are housed in the A-Frame of the pallet jack. The stabilizer member extends out of a side on the pallet jack opposite to an intended direction of travel as dictated by the steering handle, to counteract a load shift on the pallet jack. The stabilizer member includes casters on either end to provide a point of contact between the stabilizer member and a surface on which the pallet jack travels when the pallet jack starts to tilt due to the shifting load. The stabilizer member also includes a locking handle and pin for disconnecting the stabilizer member when the extension of the stabilizer member can limit the maneuverability of the pallet jack in narrow areas.

Embodiments of the present invention also provide a pallet stabilization program for actuating an electrically assisted load stabilizer member. A stabilizer member is electrically and mechanically coupled to an electric motor for extending and retracting the stabilizer member based on a measured angle on an angular position sensor located in the steering mechanism. The pallet stabilization program determines whether the stabilizer member is activated and determines whether the angular position sensor has detected a user turning the pallet jack. Responsive to the determining the user is turning the pallet jack, the pallet stabilization program activates the electric motor coupled to the stabilizer to extend or retract the stabilizer member based on the measured angle by the angular position sensor.

Detailed embodiments of the present invention are disclosed herein with reference to the accompanying drawings; however, it is to be understood that the disclosed embodiments are merely illustrative of potential embodiments of the invention and may take various forms. In addition, each of the examples given in connection with the various embodiments is also intended to be illustrative, and not restrictive. This description is intended to be interpreted merely as a representative basis for teaching one skilled in the art to variously employ the various aspects of the present disclosure. In the description, details of well-known features and techniques may be omitted to avoid unnecessarily obscuring the presented embodiments.

For purposes of the description hereinafter, terms such as "upper", "lower", "right", "left", "vertical", "horizontal", "top", "bottom", and derivatives thereof shall relate to the disclosed structures and methods, as oriented in the drawing figures. Terms such as "above", "overlying", "atop", "on top", "positioned on" or "positioned atop" mean that a first element, such as a first structure, is present on a second element, such as a second structure, wherein intervening elements, such as an interface structure may be present between the first element and the second element. The term "direct contact" means that a first element, such as a first structure, and a second element, such as a second structure, are connected without any intermediary conducting, insulating or semiconductor layers at the interface of the two elements. The term substantially, or substantially similar, refer to instances in which the difference in length, height, or orientation convey no practical difference between the definite recitation (e.g. the phrase sans the substantially similar term), and the substantially similar variations. In one embodiment, substantial (and its derivatives) denote a difference by a generally accepted engineering or manufacturing tolerance for similar devices, up to, for example, 10% deviation in value or 10° deviation in angle.

In the interest of not obscuring the presentation of embodiments of the present invention, in the following detailed description, some processing steps or operations that are known in the art may have been combined together for presentation and for illustration purposes and in some instances may have not been described in detail. In other instances, some processing steps or operations that are known in the art may not be described at all. It should be understood that the following description is rather focused on the distinctive features or elements of various embodiments of the present invention.

Many common fabrication techniques involve securing two objects using an adhesive layer between the objects. Oftentimes, the adhesive layer is chosen in an attempt to permanently secure the two objects together. And while this adhesive layer selection may be advantageous for typical usage of the overall product, there may be instances where separation of the joined objects is either desired, or necessary. In such instances, separation of the two objects, without physically damaging either of the objects, may be required so that one or both of the objects may be reused.

FIG. 1 depicts a pallet jack with a load stabilizer member, in accordance with an embodiment of the present invention. In this embodiment, pallet jack assembly 100 includes pallet jack 102 with stabilizer member 104 located in member channel 106, where stabilizer member 104 extends and retracts from at least one side of pallet jack 102 perpendicular to lifting forks 114. Alternatively, stabilizer member 104 can extend and retract at various other angles (e.g., 45 degrees or 95 degrees) from at least one side of pallet jack 102. For discussion purposes, an operator of pallet jack 102 utilizes handle 108 mechanically coupled to wheels 110 and hydraulic lift 112 at a first end of pallet jack 102. Handle 108 controls a steering angle of wheels 110 and a rate of change for the steering angle of wheels 110 is proportionate to a rate of extension or retraction of stabilizer member 104. Alternatively, the rate of extension or retraction of stabilizer member 104 can be variable based on the rate of change for the steering angle of wheels 110. For example, as an operator of pallet jack 102 turns handle 108 from a centered position (i.e., 0 degrees) to an angle up to +/−10 degrees off the centered position, stabilizer member 104 can extend or retract at a slower rate to take into account minor steering variations by the operator of pallet jack 102. As the operator of pallet jack 102 turns handle 108 from a centered position (i.e., 0 degrees) to an angle exceeding +/−10 degrees off the center position, stabilizer member 104 can extend or retract at a faster rate to take into account a turn being initiated by the operator of pallet jack 102.

Stabilizer member 104 extends opposite a direction of travel to provide load stabilization to pallet jack 102. For example, if the operator of pallet jack 102 rotates handle 108 counterclockwise, wheels 110 rotate counterclockwise with handle 108 and pallet jack 102 travels in a right-hand direction when handle 108 is pulled towards the operator. To provide stabilization to pallet jack 102 during the right-hand turn, stabilizer member 104 extends from a left side of pallet jack 102. If the operator of pallet jack 102 rotates handle 108 clockwise, wheels 110 rotate clockwise with handle 108 and pallet jack 102 travels in a left-hand direction when handle 108 is pulled towards the operator. To provide stabilization to pallet jack 102 during the left-hand turn, stabilizer member 104 extends from a right side of pallet jack 102. Alternatively, stabilizer member 104 can extend from the same side of pallet jack 102 as the direction of travel. For example, if pallet jack 102 is executing a left-hand turn, stabilizer member 104 can extend from a left side of pallet jack 102. Furthermore, pallet jack 102 can utilize a second stabilizer member 104 with a dedicated gearing mechanism, where a first stabilizer member 104 extends from one side of pallet jack 102 and the second stabilizer member 104 extends from another side of pallet jack 102.

Figure 2:
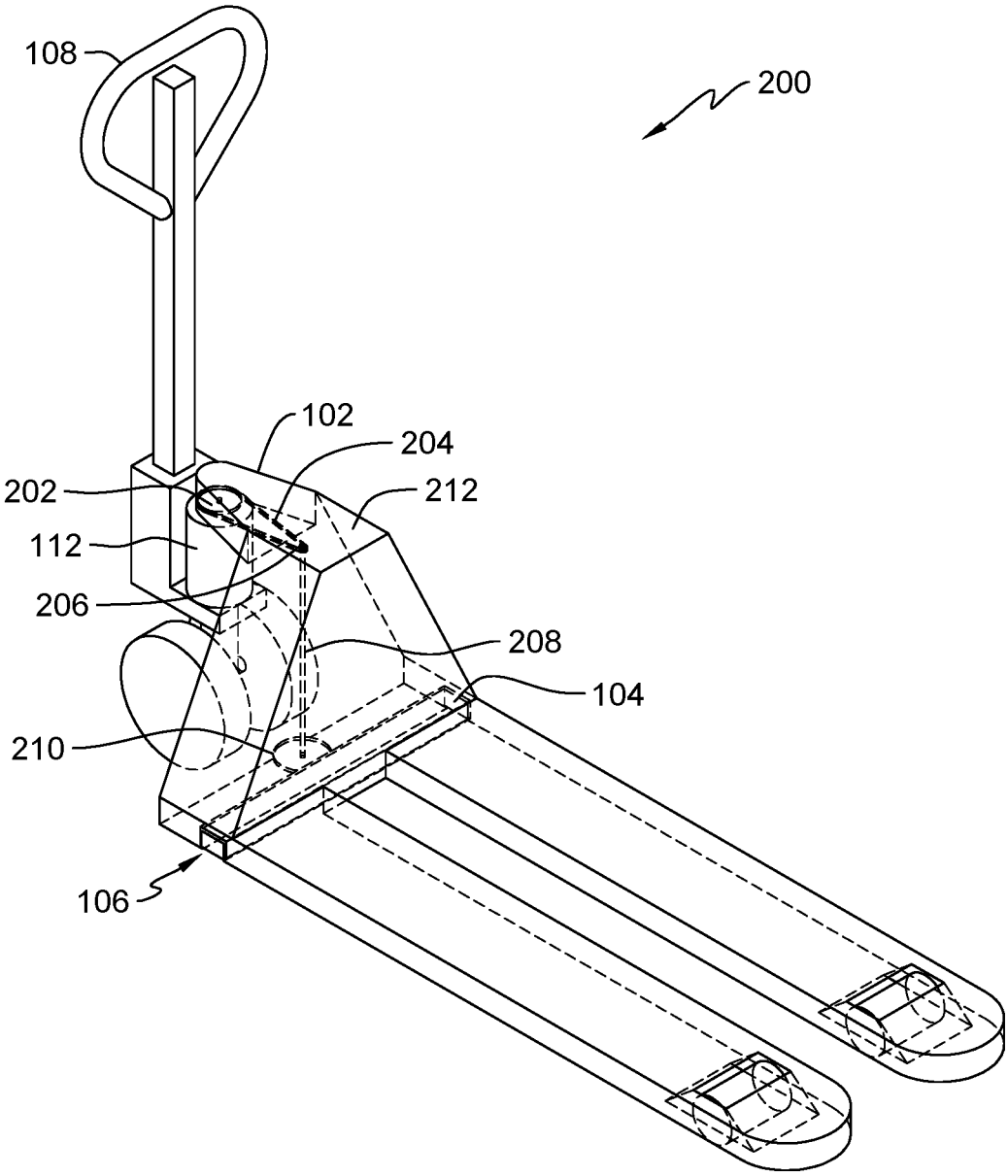
FIG. 2 depicts a transparent view of the pallet jack with the load stabilizer member of FIG. 1, in accordance with an embodiment of the present invention.

FIG. 2 depicts a transparent view of the pallet jack with the load stabilizer member of FIG. 1, in accordance with an embodiment of the present invention. In this embodiment, transparent pallet jack assembly 200 includes pallet jack 102 with stabilizer member 104 in a retracted state, where transparent pallet jack assembly 200 illustrates internal components situated in an A-Frame 212 of pallet jack 102 for controlling stabilizer member 104 via handle 108. A bottom surface of first wheel 202 is mechanically coupled to a top surface of hydraulic lift 112, where the top surface of hydraulic lift 112 rotates based on a steering angle inputted by an operator via handle 108. First wheel 202 is mechanically coupled to second wheel 206 via linkage 204, where a direction of rotation of first wheel 202 is translated to second wheel 206 via linkage 204. In one embodiment, first wheel 202 and second wheel 206 are sprockets utilizing a chain based linkage 204, where a diameter of first wheel 202 is greater than a diameter of second wheel 206. A number of protruding members (i.e., teeth) for first wheel 202 and second wheel 206 is dependent on a rate of extension and retraction of stabilizer member 104. In another embodiment, first wheel 202 and second wheel 206 are pulleys utilizing a belt based linkage 204.

Second wheel 206 is mechanically coupled to third wheel 210 via axle 208, where axle 208 translates a direction of rotation from second wheel 206 to third wheel 210. In this embodiment, third wheel 210 is a gear capable of interlocking with a gear rack located on a first side of stabilizer member 104, where third wheel 210 and the gear rack form a rack and pinion for linear actuation of stabilizer member 104. A gear rack located on the first side of stabilizer member 104 is positioned opposite third wheel 210, where third wheel 210 is capable of interlocking with the gear rack on stabilizer member 104. A number of protruding members (i.e., teeth) for third wheel 210 and the gear rack located on the first side of stabilizer member 104 is dependent on a rate of extension and retraction of stabilizer member 104.

Figure 3:
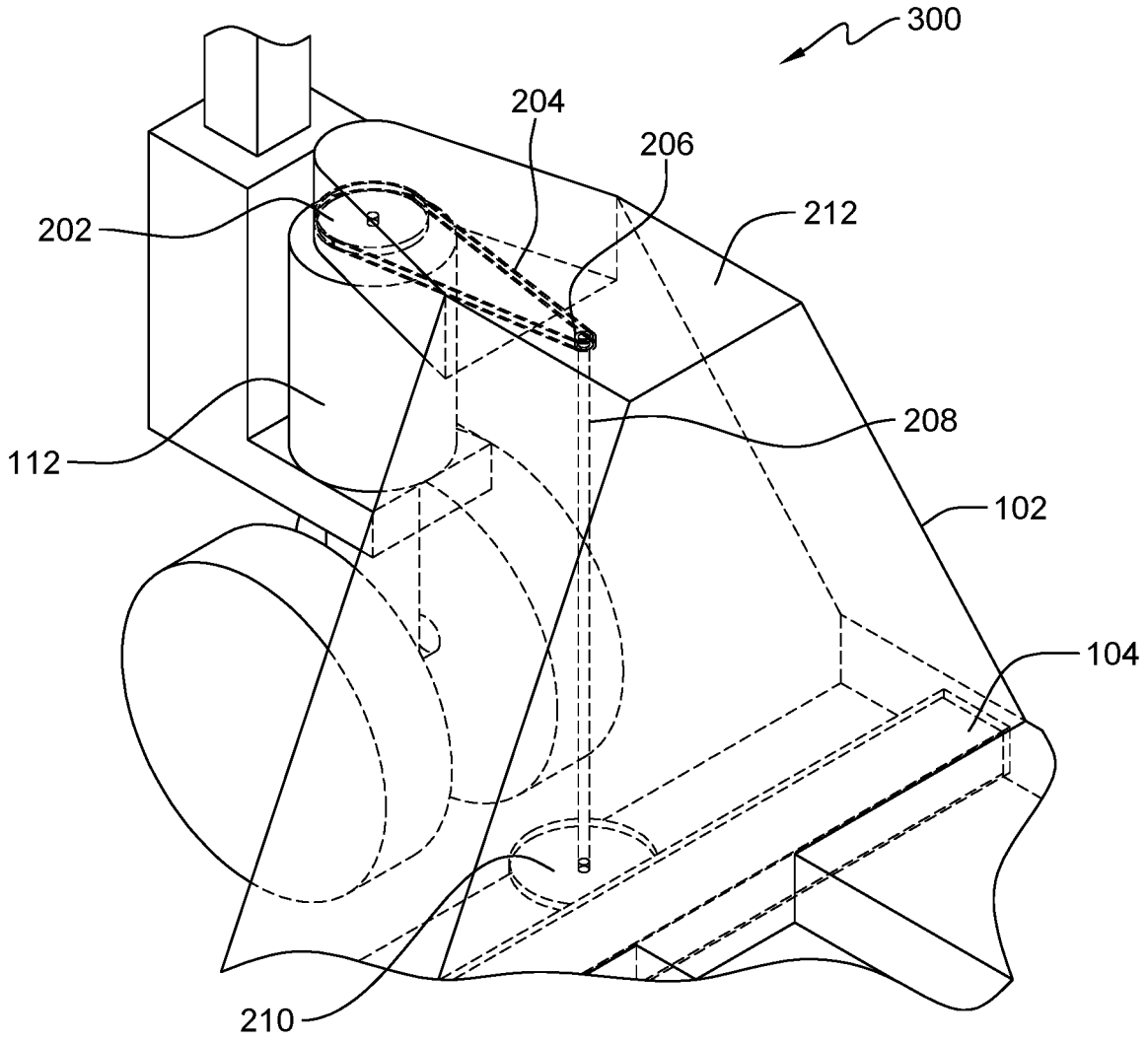
FIG. 3 depicts an enhanced transparent view of mechanical components for actuating the load stabilizer member of FIG. 1, in accordance with one embodiment of the present invention.

FIG. 3 depicts an enhanced transparent view of mechanical components for actuating the load stabilizer member of FIG. 1, in accordance with one embodiment of the present invention. In this embodiment, enhanced transparent pallet jack assembly 300 includes internal components situated in an A-Frame 212 of pallet jack 102 for controlling stabilizer member 104. As an operator pulls pallet jack 102 into a left-hand turn (i.e., X>0 degrees) from a centered position (i.e., 0 degrees), hydraulic lift 112 rotates in a clockwise direction, along with mechanically coupled first wheel 202. Linkage 204 translates the clockwise rotation of first wheel 202 to second wheel 206 and axle 208 translates the clockwise rotation of second wheel 206 to third wheel 210. The clockwise rotation of third wheel 210 is translated to the gear rack on stabilizer member 104, where stabilizer member 104 extends out of a right side of pallet jack 102. Alternatively, as an operator pulls pallet jack 102 into a right-hand turn (i.e., X<0 degrees) from a centered position (i.e., 0 degrees), hydraulic lift 112 rotates in a counterclockwise direction, along with mechanically coupled first wheel 202. Linkage 204 translates the counterclockwise rotation of first wheel 202 to second wheel 206 and axle 208 translates the counterclockwise rotation of second wheel 206 to third wheel 210. The clockwise rotation of third wheel 210 is translated to the gear rack on stabilizer member 104, where stabilizer member 104 extends out of a left side of pallet jack 102.

Pallet jack 102 can include an integrated stop lock of hydraulic lift 112 for preventing wheels 110 from rotating beyond a predetermined point (e.g., +/−90 degrees) when an operator performs a right-hand or a left-hand turn, thus preventing stabilizer member 104 from fully extending out of pallet jack 102. Alternatively, a stop lock can be integrated on either end of the gear rack on stabilizer member 104 to prevent full extension out of pallet jack 102 and to limit the rotation of hydraulic lift 112.

Figure 4:
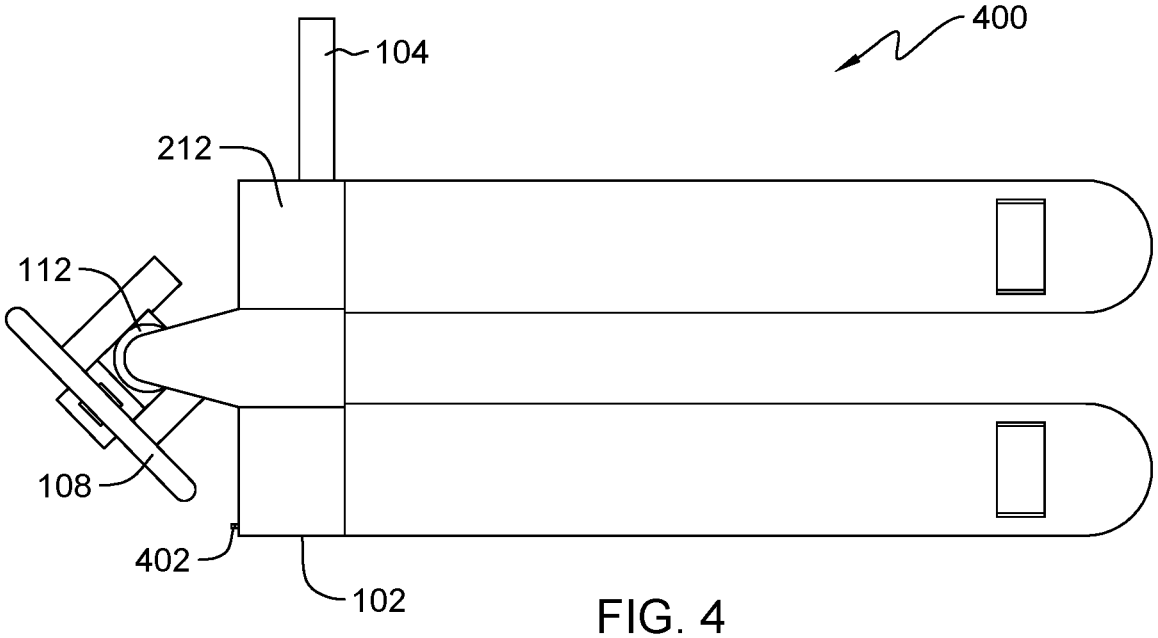
FIG. 4 depicts a top view of pallet jack with a load stabilizer member, in accordance with an embodiment of the present invention.

FIG. 4 depicts a top view of pallet jack 102 with a load stabilizer member 104, in accordance with an embodiment of the present invention. In this embodiment, top view pallet jack assembly 400 includes pallet jack 102 with stabilizer member 104 performing a right-hand turn when pulled by an operator, where stabilizer member 104 is extending out of a left side of pallet jack 102. As an operator rotates handle 108 in a counterclockwise direction to initiate the right-hand turn, the counterclockwise rotation is translated to hydraulic lift 112. The counterclockwise rotation of hydraulic lift is translated via the internal components located in the A-Frame 212 of pallet jack 102 to stabilizer member 104, resulting in stabilizer member 104 extending out of the left side of pallet jack 102. Locking handle 402, discussed in further detail with regard to FIG. 7, allows for the mechanical decoupling of stabilizer member 104, such that steering inputs by an operator at handle 108 is not translated to stabilizer member 104 (i.e., the stabilizer member 104 would not extend during a turn).

Figure 5:
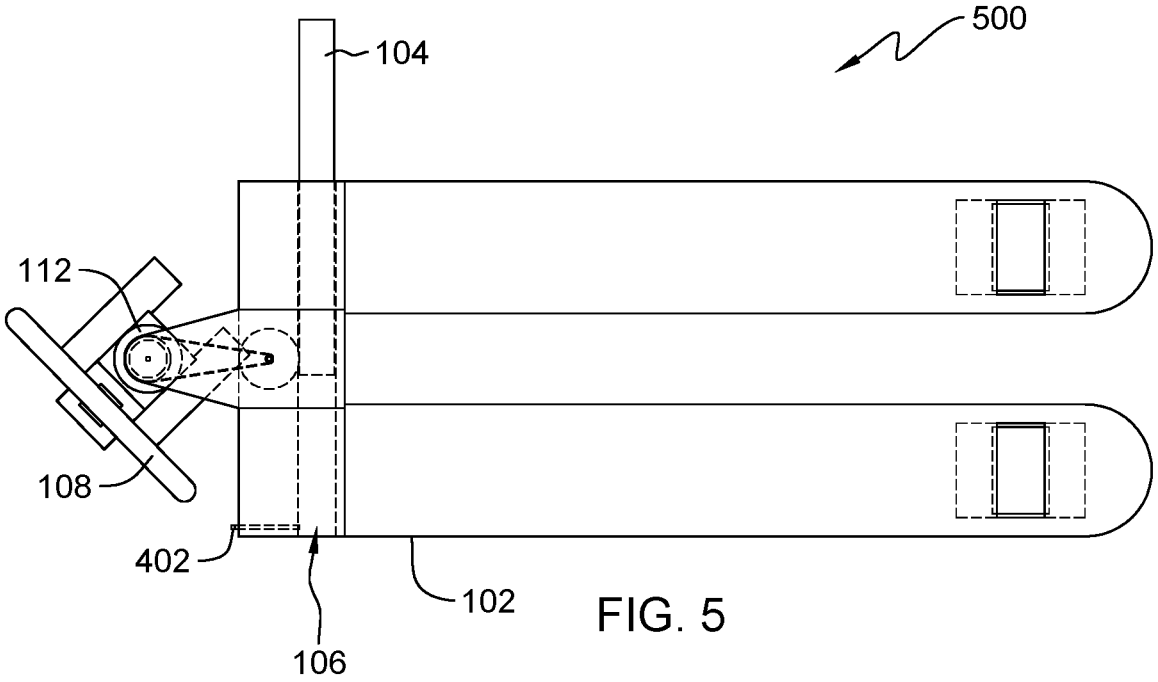
FIG. 5 depicts a transparent top view of pallet jack with a load stabilizer member, in accordance with an embodiment of the present invention.

FIG. 5 depicts a transparent top view of pallet jack 102 with a load stabilizer member 104, in accordance with an embodiment of the present invention. In this embodiment, transparent top view of pallet jack assembly 500 includes pallet jack 102 with the stabilizer member 104 from FIG. 4 performing a right-hand turn, where stabilizer member 104 is extending out of a left side of pallet jack 102.

Figure 6:
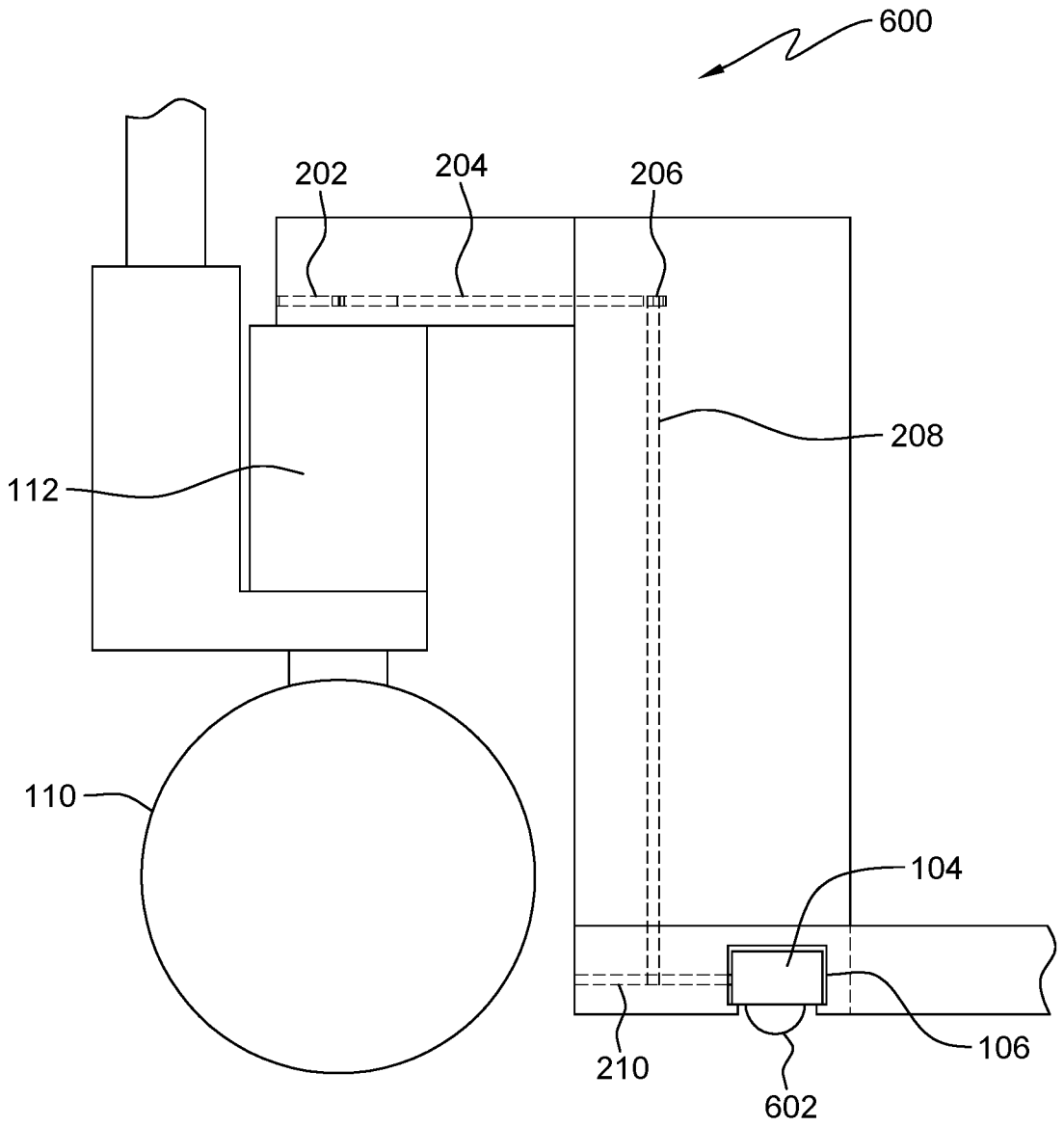
FIG. 6 depicts a transparent side view of the mechanical components for actuating the load stabilizer member of FIG. 3, in accordance with one embodiment of the present invention.

FIG. 6 depicts a transparent side view of the mechanical components for actuating the load stabilizer member of FIG. 3, in accordance with one embodiment of the present invention. In this embodiment, transparent side view of pallet of pallet jack assembly 600 includes pallet jack 102 with stabilizer member 104 and caster 602. A rotation direction of wheel 110 is translated to hydraulic lift 112, where wheel 110, hydraulic lift 112, and first wheel 202 rotate about the same y-axis. A rotational direction of first wheel 202 is translated to second wheel 206 via linkage 204, where first wheel 202 and second wheel 206 rotate about a y-axis (i.e., rotational center) and linkage 204 is perpendicular to the axis of rotation of first wheel 202 and second wheel 206. In other embodiments, a combination of a linkage tensioner (e.g., chain or belt tensioner) and link guides (e.g., chain guide) are utilized with linkage 204 to ensure longer intervals of maintenance and reliability. A rotational direction of second wheel 206 is translated to third wheel 210 via axle 208, where second wheel 206, axle 208, and third wheel 210 rotate about the same y-axis. In other embodiments, one or more bearings are positioned along the length of axle 208 to assist with the rotation about the y-axis and to prevent deflection of axle 208 when experiencing a rotational torque.

A y-axis rotational direction of third wheel 210 is translated to a z-axis movement of stabilizer member 104 via a gear rack location on a surface opposite to third wheel 210. In other embodiments, not illustrated in FIG. 6, member channel 106 includes a plurality of rollers for guiding the z-axis movement of stabilizer member 104. The plurality of rollers can be coupled to one or more of a top interior surface and a side interior surface of member channel 106. Caster 602 situated at either end of stabilizer member 104, allows for stabilizer member 104 to contact a ground surface and prevent the tipping of pallet jacket 102. Caster 602 also prevents wearing of a leading edge of stabilizer member 104.

Figure 7:
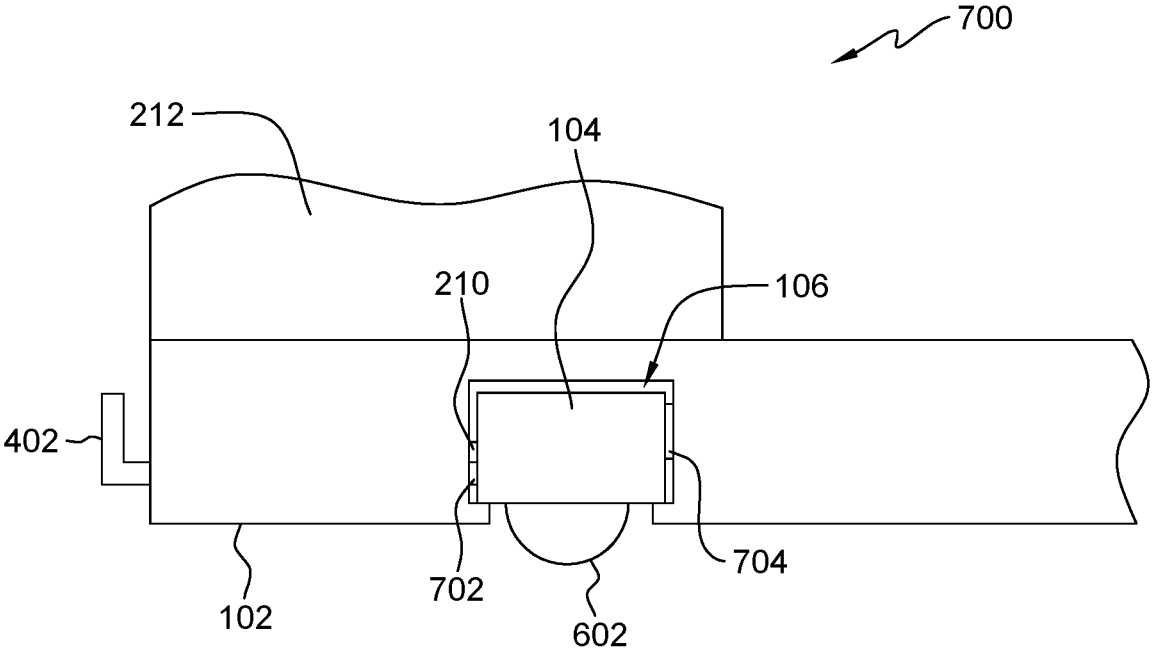
FIG. 7 depicts a side view of the load stabilizer member with a disengagement pin and a support caster, in accordance with one embodiment of the present invention.

FIG. 7 depicts a side view of the load stabilizer member with a disengagement pin and a support caster, in accordance with one embodiment of the present invention. In this embodiment, enhanced side view of pallet of pallet jack assembly 700 includes pallet jack 102 with stabilizer member 104 and locking handle 402. Locking handle 402 allows for the disengagement of stabilizer member 104, to prevent stabilizer member 104 from extended out of member channel 106. Locking handle 402 with pin 702 extends through the A-Frame 212 of pallet jack 102, where pin 702 contacts stabilizer member 104 in channel 106 on the same side where third wheel 210 contacts the gear rack of stabilizer member 104. Spring 704 is situated in channel 106 opposite pin 702, where spring 704 is biased toward engaging third wheel 210 with the gear rack of stabilizer member 104. As spring 704 is compressed due to an opposing force applied via pin 702, third wheel 210 is disconnected from the gear rack of stabilizer member 104. Stabilizer member 104 is in an engaged state with third wheel 210 when locking handle 402 is extended out of the A-frame 212 of pallet jack 102 in the negative x-axis direction and pin 702 is not in contact with stabilizer member 104. As result, spring 704 pushes on stabilizer member 104 in the negative x-axis direction until third wheel 210 contacts the gear rack of stabilizer member 104. Stabilizer member 104 is in a disengaged state with third wheel 210 when locking handle 402 is retracted into the A-Frame 212 of pallet jack 102 in the positive x-axis and pin 702 is in contact with stabilizer member 104. Pin 702 pushes against stabilizer member 104, compressing spring 704 until third wheel 210 is no longer in contact with the gear rack of stabilizer member 104. Locking handle 402 is secured in place to prevent spring 704 from moving the gear rack of stabilizer member 104 towards third wheel 210.

The terminology used herein is for the purpose of describing particular embodiments only and is not intended to be limiting to the invention. As used herein, the singular forms "a", "an" and "the" are intended to include the plural forms as well, unless the context clearly indicates otherwise.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiment, the practical application or technical improvement over technologies found in the marketplace, or to enable other of ordinary skill in the art to understand the embodiments disclosed herein. It is therefore intended that the present invention not be limited to the exact forms and details described and illustrated but fall within the scope of the appended claims.

Figure 8:
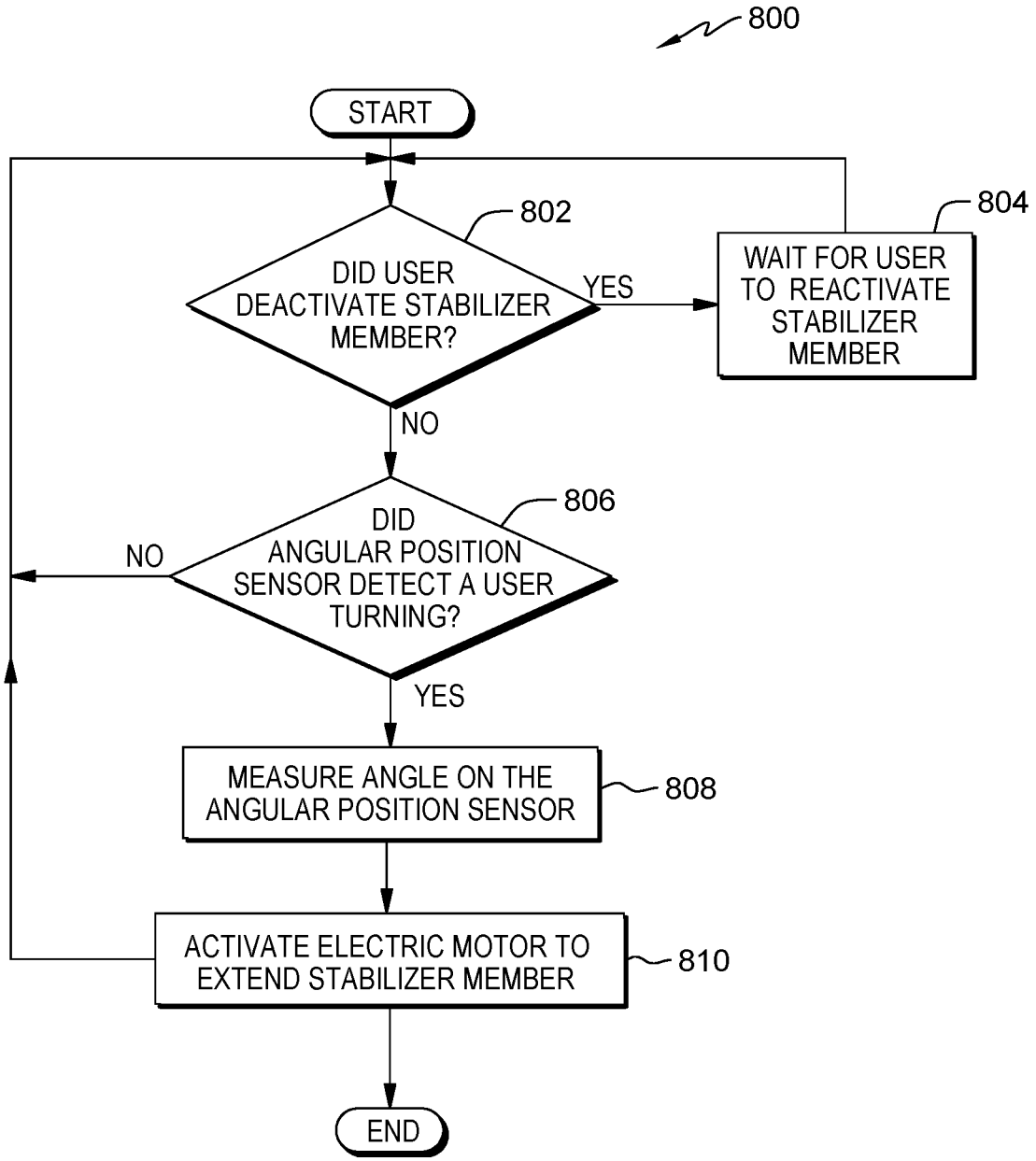
FIG. 8 is a flowchart depicting operational steps of a pallet stabilization program for actuating an electrically assisted load stabilizer member of a pallet jack, in accordance with one embodiment of the present invention.

FIG. 8 is a flowchart depicting operational steps of a pallet stabilization program for actuating an electrically assisted load stabilizer member of a pallet jack, in accordance with one embodiment of the present invention.

In this embodiment, pallet stabilization program 800 utilizes an angular position sensor, an electric motor, a power source, and a processor. Pallet stabilization program 800 utilizes the angular position sensor to measure a steering angle of the wheels on the pallet jack, where the angular position is coupled to the steering mechanism of the pallet jack. Pallet stabilization program 800 utilizes the processor to determine and activate an extension of the electrically assisted load stabilizer member based on the steering angle received from the angular position sensor. Pallet stabilization program 800 utilizes the electric motor electrically coupled to the power source and mechanically coupled to the electrically assisted load stabilizer member to extend the stabilizer member out of either side of the pallet jack. Pallet stabilization program 800 can be implemented on a mechanical pallet jack with the electrically assisted load stabilizer member or an electrically powered pallet jack, where an onboard power source on the electrically powered pallet jack supplies power to the electrical motor mechanically coupled to the electrically assisted load stabilizer member and the wheels for assisted movement.

In this embodiment, pallet stabilization program 800 determines whether a user has deactivated stabilizer member (802). Pallet stabilization program 800 includes a user interface, where the user can specify whether the stabilizer member is to be activated based on the measured angle at the angular position sensor. Alternatively, pallet stabilization program 800 can utilize a power cutoff switch to disconnect the power supply from the electrical motor for actuating the stabilizer member. In the event, pallet stabilization program 800 determines the user has deactivated the stabilizer member ("yes" branch, 802), pallet stabilization program 800 waits (i.e., idles) until the user reactivates the stabilizer member (804). In the event, pallet stabilization program 800 determines the user has not deactivated the stabilizer member ("no" branch, 802), pallet stabilization program 800 determines whether an angular position sensor detected a user turning the wheels of the pallet jack (806).

Pallet stabilization program 800 waits until the user reactivates the stabilizer member (804). Pallet stabilization program 800 waits until a user input is received via the user interface specifying the activation of the stabilizer member on the pallet jack. Alternatively, pallet stabilization program 800 waits until the user electrically connects the power supply to the electrical motor for actuating the stabilizer member via the power cutoff switch. During this idle state, pallet stabilization program 800 can still receive angle measurements from the angular position sensor and store these measurement for set intervals of utilization (e.g., 10 milliseconds). In an alternative embodiment, pallet stabilization program 800 utilizes an accelerometer for measuring tilt in conjunction with the angular position sensor to provide the user a recommendation, via the user interface, to reactivate the stabilizer member. Pallet stabilization program 800 provides the user of the pallet jack an option to deactivate the stabilizer for a predetermined amount of time (e.g., 30 seconds) to allow the user to perform a turn in a narrow area, where an extension of the stabilizer member would hinder maneuverability in the narrow area. Subsequent to completion of the predetermined amount of time, pallet stabilization program 800 reactivates the stabilizer member to ensure the user of the pallet jack does not forget to manually reactivate the stabilizer member.

In this embodiment, pallet stabilization program 800 determines whether an angular position sensor detected a user turning the wheels of the pallet jack (806). In the event that pallet stabilization program 800 determines the angular position sensor detected the user turning the wheels of the pallet jack ("yes" branch, 806), pallet stabilization program 800 measures an angle on the angular position sensor (808). In the event that pallet stabilization program 800 determines the angular position sensor did not detect the user turning the wheels of the pallet jack ("no" branch, 806), pallet stabilization program 800 reverts to determining whether a user has deactivated stabilizer member (802).

Pallet stabilization program 800 measures an angle on the angular position sensor (808). Based on the measured angle on the angular position sensors, pallet stabilization program 800 activates the electric motor to extend the stabilizer member (810). A side on the pallet jack from which pallet stabilization program 800 extends the stabilizer member is based on a direction of travel of the pallet jack. The direction of travel is based on a positive or negative notation for measured angle on the angular position sensor. For example, a negative 20 degrees measured angle represents a right-hand turn as the user pulls the pallet jack and pallet stabilization program 800 activates the electric motor to extend the stabilizer member out of the left side of the pallet jack. A positive 20 degrees measured angle represents a left-hand turn as the user pulls the pallet jack and pallet stabilization program 800 activates the electric motor to extend the stabilizer member out of the right side of the pallet jack.

A distance of extension of the stabilizer member is based on the measured angle on the angular position sensor and a rate of change in the measured angle on the angular position sensor. For example, the greater the measured angle on the angular position sensor (e.g., +/−45 degrees), the greater the distance of extension of the stabilizer member when pallet stabilization program 800 actives the electric motor to extend the stabilizer member out of the pallet jack. For minor steering corrections (e.g. +/−10 degrees), due to surface imperfections on which the pallet jack travels, pallet stabilization program 800 can determine not to active the electric motor to extend the stabilizer member. The rate of change in the measured angle on the angular position sensor dictates a rate of extension of the stabilizer member by pallet stabilization program 800 and a distance of extension of the stabilizer member. For example, if the rate of change in the measured angle on the angular position sensor is below a threshold (e.g., 10 degrees per 0.1 seconds), pallet stabilization program 800 activates the electric motor to extend the stabilizer member based on the measured angle on the angular position at a predetermined extension rate. If the rate of change in the measured angle on the angular position sensor is above the threshold, pallet stabilization program 800 activates the electric motor to extend the stabilizer member based on the measured angle on the angular position at a faster rate to compensate for the rapid change of direction of the pallet jack. The rapid change of direction of the pallet can cause the load to shift (i.e., tip over), due to a high center of gravity of the load and a momentum change of the load.

In another embodiment, the pallet jack includes at least one or more distance sensors located on a side of the pallet jack from which the stabilizer member extends and retracts from. The distance sensors (e.g., ultrasonic sensors) allow for pallet stabilization program 800 to determine a distance the stabilizer member can extend out from the pallet jack to avoid contacting objects in the surrounding environment. Additionally, the distance sensors can be integrated into a leading edge (i.e., side) of the stabilizer member to provide a more accurate reading.

Figure 9:
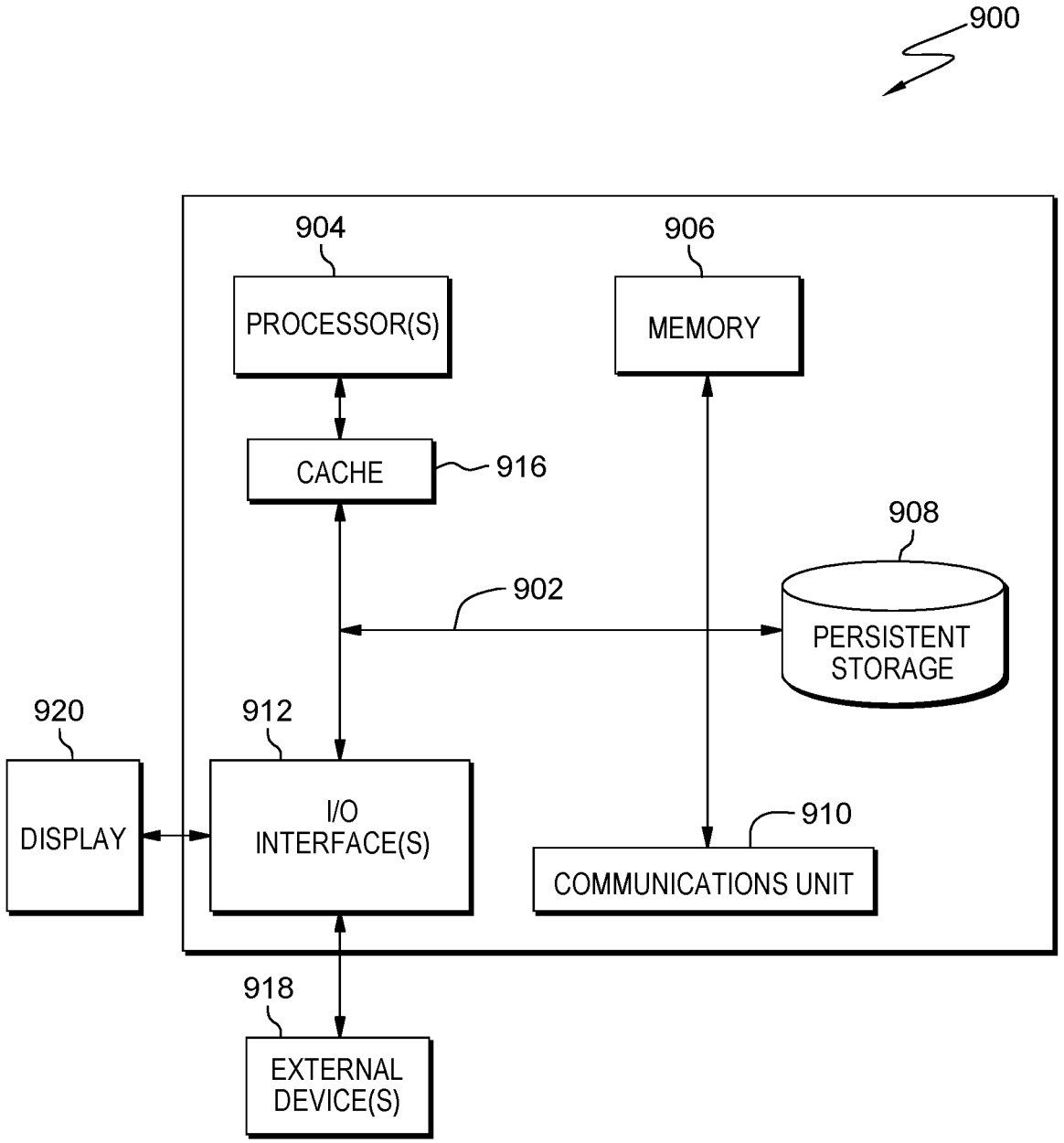
FIG. 9 depicts a block diagram of components of a computer system for performing the operational steps of the pallet stabilization program, in an embodiment, in accordance with the present invention.

FIG. 9 depicts a block diagram of components of a computer system for performing the operational steps of the pallet stabilization program, in an embodiment, in accordance with the present invention. Computer system 900, where embedded microcontroller 904 is an example of a system that includes battery cell containment program 800. The computer system includes processors 904, cache 916, memory 906, persistent storage 908, communications unit 910, input/output (I/O) interface(s) 912 and communications fabric 902. Communications fabric 902 provides communications between cache 916, memory 906, persistent storage 908, communications unit 910, and input/output (I/O) interface(s) 912. Communications fabric 902 can be implemented with any architecture designed for passing data and/or control information between processors (such as microprocessors, communications and network processors, etc.), system memory, peripheral devices, and any other hardware components within a system. For example, communications fabric 902 can be implemented with one or more buses or a crossbar switch.

Memory 906 and persistent storage 908 are computer readable storage media. In this embodiment, memory 902 includes random access memory (RAM). In general, memory 906 can include any suitable volatile or non-volatile computer readable storage media. Cache 916 is a fast memory that enhances the performance of processors 904 by holding recently accessed data, and data near recently accessed data, from memory 906.

Program instructions and data used to practice embodiments of the present invention may be stored in persistent storage 908 and in memory 906 for execution by one or more of the respective processors 904 via cache 916. In an embodiment, persistent storage 908 includes a magnetic hard disk drive. Alternatively, or in addition to a magnetic hard disk drive, persistent storage 908 can include a solid state hard drive, a semiconductor storage device, read-only memory (ROM), erasable programmable read-only memory (EPROM), flash memory, or any other computer readable storage media that is capable of storing program instructions or digital information.

The media used by persistent storage 908 may also be removable. For example, a removable hard drive may be used for persistent storage 908. Other examples include optical and magnetic disks, thumb drives, and smart cards that are inserted into a drive for transfer onto another computer readable storage medium that is also part of persistent storage 908.

Communications unit 910, in these examples, provides for communications with other data processing systems or devices. In these examples, communications unit 910 includes one or more network interface cards. Communications unit 910 may provide communications through the use of either or both physical and wireless communications links. Program instructions and data used to practice embodiments of the present invention may be downloaded to persistent storage 908 through communications unit 910.

I/O interface(s) 912 allows for input and output of data with other devices that may be connected to each computer system. For example, I/O interface 906 may provide a connection to external devices 918 such as a keyboard, keypad, a touch screen, and/or some other suitable input device. External devices 918 can also include portable computer readable storage media such as, for example, thumb drives, portable optical or magnetic disks, and memory cards. Software and data used to practice embodiments of the present invention can be stored on such portable computer readable storage media and can be loaded onto persistent storage 908 via I/O interface(s) 912. I/O interface (s) 912 also connect to display 920.

Display 920 provides a mechanism to display data to a user and may be, for example, a computer monitor.

The programs described herein are identified based upon the application for which they are implemented in a specific embodiment of the invention. However, it should be appreciated that any particular program nomenclature herein is used merely for convenience, and thus the invention should not be limited to use solely in any specific application identified and/or implied by such nomenclature.

The present invention may be a system, a method, and/or a computer program product. The computer program product may include a computer readable storage medium (or media) having computer readable program instructions thereon for causing a processor to carry out aspects of the present invention.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present invention may be assembler instructions, instruction-set-architecture (ISA) instructions, machine instructions, machine dependent instructions, microcode, firmware instructions, state-setting data, or either source code or object code written in any combination of one or more programming languages, including an object oriented programming language such as Smalltalk, C++ or the like, and conventional procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present invention.

Aspects of the present invention are described herein with reference to flowchart illustrations and/or block diagrams of methods, apparatus (systems), and computer program products according to embodiments of the invention. It will be understood that each block of the flowchart illustrations and/or block diagrams, and combinations of blocks in the flowchart illustrations and/or block diagrams, can be implemented by computer readable program instructions.

These computer readable program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowchart and block diagrams in the Figures illustrate the architecture, functionality, and operation of possible implementations of systems, methods, and computer program products according to various embodiments of the present invention. In this regard, each block in the flowchart or block diagrams may represent a module, segment, or portion of instructions, which comprises one or more executable instructions for implementing the specified logical function(s). In some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

What is claimed is:

1. An apparatus for load stabilization on a pallet jack, the apparatus comprising:

one or more steerable wheels, a stabilizer member, and an A-Frame, wherein the A-Frame encloses a plurality of components for mechanically coupling the one or more steerable wheels to the stabilizer member; and the stabilizer member is extendable out of at least one side of the pallet jack based at least on an angle of rotation of the one or more steerable wheels.

2. The apparatus of claim 1, wherein a direction for which the stabilizer member is extendable out of at least one side of the pallet jack is opposite to a direction of travel for the one or more steerable wheels.

3. The apparatus of claim 1, wherein an extension of the stabilizer member is dependent on an angle of rotation of the one or more steerable wheels.

4. The apparatus of claim 1, further comprising:

a caster mechanically coupled to a lower surface of the stabilizer member, wherein the caster contacts a surface of travel of the pallet jack.

5. The apparatus of claim 1, wherein the plurality of components comprises:

a first-round member coupled to the one or more steerable wheels, wherein a direction of rotation of the one or more steerable wheels is translated to the first-round member;

a second-round member coupled to the first-round member, wherein a direction of rotation of the first-round member is translated to the second-round member;

a third-round member coupled to the second-round member, wherein a direction of rotation of the second-round member is translated to the third-round member; and the stabilizer member coupled to the third-round member, wherein a direction of rotation of the third-round member is translated to the stabilizer member.

6. The apparatus of claim 5, wherein the first-round member and the second-round member are sprockets coupled via a chain.

7. The apparatus of claim 6, where a gear ratio of the first-round member varies from a gear ratio of the second-round member.

8. The apparatus of claim 5, wherein the first-round member and the second-round round member are pulleys coupled via a belt.

9. The apparatus of claim 8, where a gear ratio of the first-round member varies from a gear ratio of the second-round round member.

10. The apparatus of claim 5, wherein the third-round member is coupled to the second-round member via an axle.

11. The apparatus of claim 10, wherein a gear ratio of the third-round member varies from a gear ratio of the first-round member and a gear ratio of the second-round member.

12. The apparatus of claim 5, further comprising:

a gear rack of the stabilizer member on a surface opposite to a latitudinal surface of the third-round member, wherein the third-round member is a gear that interconnects with the gear rack of the stabilizer member.

13. The apparatus of claim 12, further comprising:

a stabilizer member decoupling mechanism that includes a locking handle, a pin, and a spring, wherein the locking handle is connected to the pin; and the pin is configured to press on the stabilizer member at the surface opposite to a latitudinal surface of the third-round member, where the pin pressing on the stabilizer member disconnects the gear that interconnects with the gear rack on the stabilizer member.

14. The apparatus of claim 13, wherein the spring is configured to press the gear rack of the stabilizer member towards the third-round member.

15. The apparatus of claim 1, further comprising:

an electric motor, an angular position sensor, a processor, and a power supply electrically coupled to the electric motor, the angular position sensors, and the processor;

the angular position sensor configured to measure a steering angle of the one or more steerable wheels; and the electric motor mechanically coupled to the stabilizer member for extending the stabilizer member out of the at least one side of pallet jack based at least on the angle of rotation of the one or more steerable wheels from the angular position sensor.

16. A method comprising:

receiving, by one or more processors, a steering angle for one or more steerable wheels of a pallet jack from an angular position sensor; and activating, by one or more processors, an electric motor for extending a stabilizer member of the pallet jack, wherein a distance of extension of the stabilizer member is based on the steering angle for one or more steerable wheels of the pallet jack.

17. The method of claim 16, further comprising:

responsive to determining a user has deactivated the stabilizer member deactivating, by one or more processors, the stabilizer for a predetermined amount of time, wherein the electric motor does not extend the stabilizer member of the pallet jack; and responsive to determining the predetermined amount of time has passed, activating, by one or more processors, the stabilizer member.

18. The method of claim 16, wherein a rate of extension of the stabilizer member is based on a rate of change in the steering angle for the one or more steerable wheels of the pallet jack.

19. The method of claim 16, wherein a side of the pallet jack from which the electric motor extends the stabilizer member is opposite to a direction of travel of the pallet jack.

20. The method of claim 19, wherein the direction of travel of the pallet jack is based on the angle of rotation of the one or more steerable wheels from the angular position sensor.

* * * * *